United States Patent [19]

Hurni

[11] 4,222,736

[45] Sep. 16, 1980

[54] ROTARY TUBULAR KILN AND SATELLITE COOLER THEREFOR WITH IMPROVED SUPPORT MEANS

[75] Inventor: Samuel Hurni, Niederuzwil, Switzerland

[73] Assignee: Gebrueder Buehler AG, Switzerland

[21] Appl. No.: 969,293

[22] Filed: Dec. 14, 1978

[30] Foreign Application Priority Data

Dec. 21, 1977 [CH] Switzerland ..... 15657/77

[51] Int. Cl.[3] ..... F27B 15/02

[52] U.S. Cl. ..... 432/80; 432/103; 432/251

[58] Field of Search ..... 432/80, 103, 251

[56] References Cited

U.S. PATENT DOCUMENTS

| | | | |
|---|---|---|---|
| 1,830,959 | 11/1931 | Petersen | 432/80 |
| 3,669,433 | 6/1972 | Hurst | 432/103 |
| 3,794,462 | 2/1974 | Sylvest | 432/80 |
| 4,059,397 | 11/1977 | Adler | 432/80 |

*Primary Examiner*—John J. Camby

*Attorney, Agent, or Firm*—McGlew and Tuttle

[57] ABSTRACT

Individual suspension of satellite cooling tubes with the aid of wire cables in the region of the discharge end of a revolving tubular kiln in two support locations spaced apart on the axial direction. Each suspension unit comprises a number of suspension elements selectable according to the operative requirements. These elements preferably include three pretensioned wire cables anchored to suitable retaining elements secured to the kiln casing. In a preferred embodiment, the wire cables are arranged so that two of them exert upon the associated cooling tube a tractive force, the resultant of which is oriented towards the kiln axis, whereas the third wire cable, which is anchored by at least one resilient element, applies to the cooling tube a force directed in opposition to the resultant and of equal value. Due to a uniform application of forces by the wire cables at the shell of the cooling tubes, and in the absence of rigid connections, localized stress concentrations caused by thermal expansion and load cycling during kiln operation, and hence the risk of cracks and fractures in the entire arrangement, can be largely prevented.

11 Claims, 6 Drawing Figures

ROTARY TUBULAR KILN AND SATELLITE COOLER THEREFOR WITH IMPROVED SUPPORT MEANS

BACKGROUND OF THE INVENTION

1. Field of the Invention

The invention relates to a rotary tubular kiln with a satellite cooler. In such a kiln and cooler combination, the cooling tubes are commonly held by support means that allow for thermal expansion of the cooling tubes. Such support means are located in the discharge region of the rotary tubular kiln at two fixing locations on the kiln casing spaced apart in the axial direction. Each of the cooling tubes communicates at its inlet end by way of an inlet pipe with the interior of the kiln.

Rotary tubular kilns of this type are used in the production of cement clinker. When such a rotary tubular kiln is in service, the kiln casing, cooling tubes and support means are subjected to highly variable stresses due, on the one hand, to their heating, which frequently exhibits extreme local variations, and, on the other hand, to the mechanical load cycling of the cooling tubes by the material being cooled owing to the revolution of the kiln.

2. Statement of Prior Art

Attempts were first made to prevent the expensive damage such as cracks and fractures of the support means and of the kiln casing which are caused by the co-operation of these effects, by use of intrinsically rigid retaining or bracing elements for the cooling tubes mounted so as to be tiltable in the axial direction on the kiln, casing and on the cooling tube, which permitted an unobstructed thermal expansion of the cooling tube only in the direction of the kiln's longitudinal axis.

In view of the unsatisfactory results, attempts were made to give the cooling tubes also a restricted radial thermal expansion by redesigning the support means.

In one known arrangement of this type annular support means are illustrated in West German OS 25 19 458. Such a support means comprises a sheet metal plate attached to the kiln casing, the sheet metal plate having an inner and an outer annular zone in the radial direction, using an interposed elastic bush, if desired. The two annular zones can be joined by slotted radial struts constructed integrally with them, or by plate rings.

The cooling tubes are accommodated in the plate rings or in the circular orifices formed by the arcuate radial struts so as to leave an annular gap, whilst they are screwed to the retaining elements, each by two lugs provided mutually opposite in the peripheral direction of the sheet metal plate on the radial struts, the plate rings, or the cooling tube shell itself. Where plate rings are used, they should be fixed, likewise by means of screws, to the inner and the outer annular zone of the sheet metal plate.

It is further possible for the inner and outer annular zones of the sheet metal plate to be composed of segment-like elements arranged in staggered relationship in the axial direction, whilst the segments overlap partly in the axial direction.

Lastly, a lamellar arrangement of the sheet metal plates is also possible.

The prior art support means described permit an unobstructed axial thermal expansion of the cooling tubes during service. However, their thermal expansion in the radial direction is restricted at the lugs, in which local stress concentrations occur, as they also do in the adjacent region of the cooling tube due to the turning of the latter. Having regard to the cyclic loads which act upon the cooling tubes during the revolution of the kiln and which are produced in constantly changing planes due to sagging of the cooling tubes, an increased danger of fracture occurs at these points of concentrated thermic stresses. The screw joints of the plate rings to the inner and outer annular zone of the sheet metal plate are threatened for similar reasons.

OBJECTS AND SUMMARY OF THE INVENTION

The main object of the invention is to provide a rotary tubular kiln and its satellite cooler with very simple support means for the satellite cooling tubes which avoid the above-described disadvantages and allow the necessary degrees of freedom for the changes in shape of the cooling tubes dictated by thermal expansion and load cycling during service, thereby avoiding or at least greatly reducing the risk of cracking or fracture of kiln casing cooling tubes and support elements.

Other objects will be apparent from the following specification together with the drawings.

Accordingly, the invention provides an improved rotary tubular kiln and satellite cooler means. A tubular kiln casing forms part of the kiln, and a plurality of cooling tubes together constitutes a satellite cooler. Support means are provided for holding the cooling tubes in predetermined positions relative to the kiln casing in a discharge region of the kiln at two support locations spaced axially with respect to the kiln. The cooling tubes include inlet pipes that communicate with the interior of the kiln at the inlet sides of the cooling tubes; and wire cables form suspension means to support the cooling tubes so as to allow for thermal expansion of the cooling tubes.

The wire cable suspension is a simple arrangement for applying the forces in a way that causes them to be uniformly distributed along the circumference of the cooling tubes. Localised stress concentrations in the tube shell, with resulting damage of the same and of the suspension elements, cannot occur.

Such a suspension means can permit the changes in shape of the cooling tubes in all directions with negligible reaction during service.

The forces acting in the arrangement embodying the invention can be determined by calculation and therefore controlled in a simpler and above all safer manner compared to those in known devices. The number of the cooling tubes and their distance from each other and from the kiln casing can be selected within certain limits. The cooling tubes can be mounted close together, which is a frequent design requirement.

The suspension means as provided by the invention has the advantage of being suitable for rough kiln service due to its insensitivity.

According to a preferred embodiment of the invention, it is recommended that each cooling tube be provided with individual suspension means independent of those of the remaining cooling tubes. This permits individual assembly and exchangeability of the cooling tubes and also permits individual tensioning and replacement of the wire cables.

As a further development, the suspension means may conveniently be assembled from a plurality of elements, whilst each suspension element is constituted by three pretensioned wire cables, two of which are provided as tension cables and draw the relevant cooling tube towards the kiln casing, whereas the third wire cable bears against the cooling tube in opposition to the two traction cables and tends to draw it away from the kiln casing Preferably, at least one of the wire cables is anchored by resilient connecting elements. The third wire cable should also have at least one resilient anchorage means.

Alternatively, wire cables with increased inherent resilience which corresponds to the tensioning force of the resilient anchorage means may be provided.

As a further development of the suspension means there may be provided at the two support locations on the kiln casing a number, corresponding to that of the cooling tubes, of pairs of brackets with anchorage elements provided between them for the wire cables. The third wire cable of each suspension element of each respective cooling tube, considered in plan of its shell from the direction of the kiln casing, is cradles the cooling tube shell and extends between the two associated traction cables. The third cable is tensioned between the anchorage beams provided for that purpose on the two pairs of brackets on both sides of the cooling tube, whilst it is in contact with the portion of the shell section of the cooling tube facing the kiln casing and is attached to at least one of the anchorage beams by a resiliently yielding tensioning device.

The two traction cables of all the suspension elements of each respective cooling tube may then be arranged so that each traction cable embraces the anchorage pipe of one of the two pairs of brackets on both sides of the cooling tube and the cooling tube itself, whilst it is in contact with the shell section of the cooling tube remote from its anchorage pipe. The arrangement is preferably chosen so that the planes containing the axis of the cooling tube and that of one respective anchorage pipe are inclined symmetrically at an angle of 35° to 60° with reference to the radial plane through the axes of the rotary tubular kiln and of the cooling tube.

The mutually crossing two ends of each traction cable may be anchored jointly to a bracket. The bracket should be welded to the shell section of the cooling tube remote from the kiln casing so that it lies substantially in the radial plane through the axes of that cooling tube and the kiln. The two ends of a respective traction cable are then passed in opposite directions through correspondingly provided bores of the bracket, being firmly held by way of a tensioning device arranged adjacent the bores.

For fixing the inlet ends of the cooling tubes with respect to the axial direction, a holding device is preferably provided in the region between the inlet pipe and the adjacent support location and extends between the rotary tubular kiln and the relevant cooling pipe end.

BRIEF DESCRIPTION OF THE DRAWINGS

A preferred embodiment of the invention will now be described by way of example with reference to the accompanying drawings, wherein.

DETAILED DESCRIPTION OF THE PREFERRED EMBODIMENT

Figure 1:
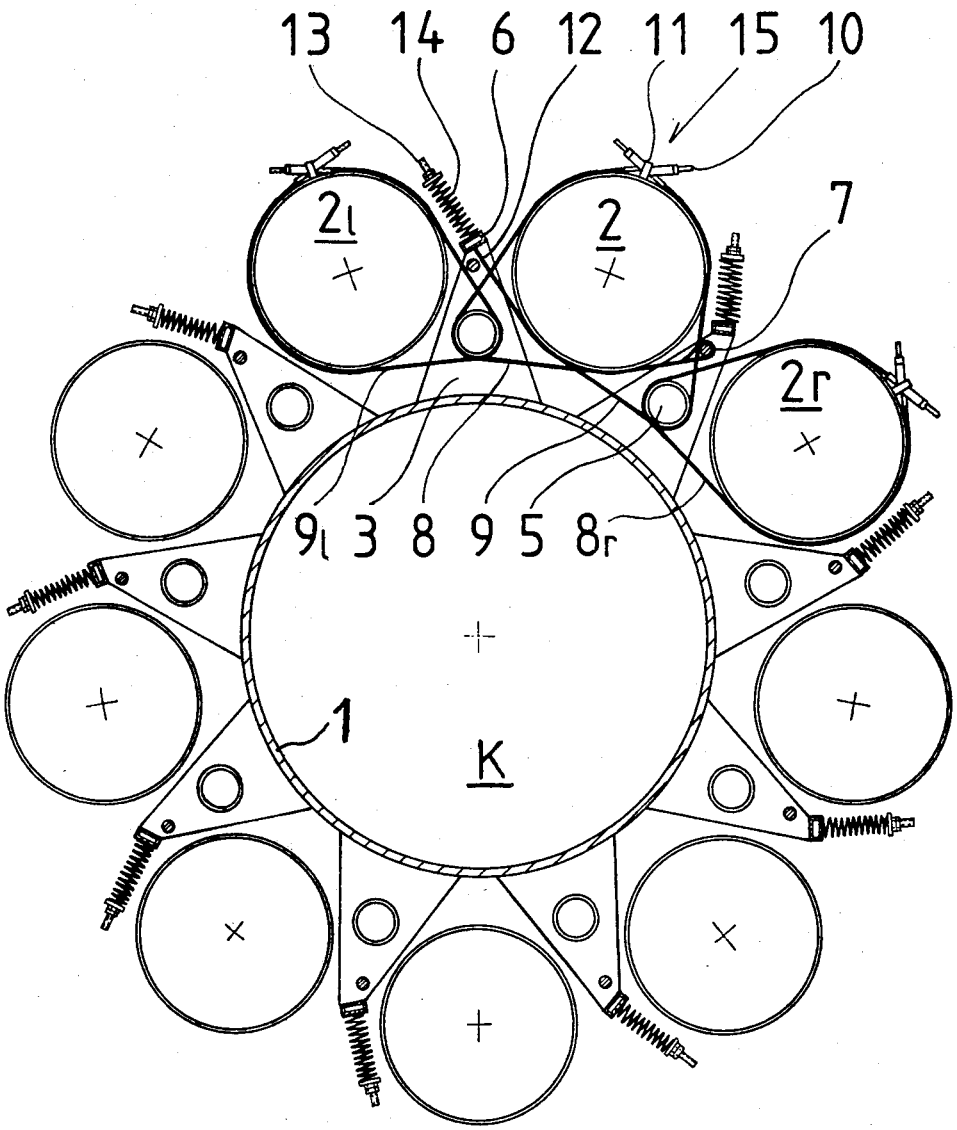
FIG. 1 shows a cross-section through the discharge section of a rotary tubular kiln with satellite cooler in the section plane A—A in FIG. 3, including the suspension means by which the satellite cooling tubes are fixed to the rotary tubular kiln.

The same reference numerals designate identical or equivalent parts in all the figures.

In FIG. 1, a rotary tubular kiln generally designated K has a cylindrical kiln casing 1 around which are arranged cooling tubes 2 which constitute a so called satellite cooler. The cooling tubes 2 are spaced at equal angular intervals around the kiln casing 1 and at an equal radial distance from it.

A number of fixed pairs of brackets 3, 4, (see FIG. 3) corresponding to the number of the cooling tubes 2 is present on the rotary tubular kiln K, of each of which the rear bracket 3 when viewed in FIG. 1 is visible.

Between the centres of the substantially triangular internal surfaces of the brackets 3, 4 of the pairs of brackets (see also FIG. 6) there are fixed three anchorage elements, namely; an anchorage beam in the form of an anchorage pipe 5, an anchorage beam of rectangular corss-section attached to the obliquely flattened apex regions of each of the brackets 3, 4, and beneath the beam 6 a further anchorage beam 7 with a smaller circular cross-section then that of the anchorage pipe 5.

The mode of fixing the cooling tubes 2 to the anchorage elements 5, 6 and 7 oriented axially parallel to them (see also FIGS. 3 and 6) is, for the sake of clarity, fully illustrated only in the case of the cooling tube 2 located top right of the vertical line of symmetry of the rotary tubular kiln in FIG. 1.

A wire cable 8, 9 is pulled tight around each of the two anchorage pipes 5 on both sides of the cooling tube 2 and about the section of the shell of the cooling tube 2 remote from these two anchorage pipes 5, whereby the cooling tube 2 is drawn radially towards the kiln casing 1. The two crossing ends of the traction cable 8 and the two crossing ends of the traction cable 9 are retained in each case by means of a tensioning device 10 on a bracket 11 which is fixed to the cooling tube 2 along its outer shell in a line extending at right angles to the plane of illustration of FIG. 1 and diametrically opposite the tubular kiln casing 1.

The mode of fixing the traction cable $9_l$ of the adjacent cooling tube $2_l$ on the left-hand side to the anchorage pipe 5 to the left of the cooling tube 2, and the mode of fixing the traction cable $8_r$ of the adjacent cooling tube $2r$ on the right-hand side to the anchorage tube 5 to the right of the cooling tube 2, are illustrated.

One end of a third wire cable 12 is anchored firmly to the circular anchorage beam 7 of the pair of brackets 3, 4 to the right of the cooling tube 2 and the other end of this cable is resiliently yieldingly attached by means of a further tensioning device 13 and helical spring 14 to the rectangular anchorage beam 6 of the pair of brackets 3, 4 to the left of the cooling tube 2. The third wire cable 12 presses against the section of the shell of the cooling tube 2 facing the tubular kiln casing 1 and extends between the two associated traction cables 8,9 to maintain the cooling tube 2 in an equilibrium of forces at a predetermined distance from the kiln casing 1 in opposition to the action of the two traction cables 8,9, all the cables 8,9,12 and the spring 14 being pretensioned.

It will be seen from FIG. 1 that by virtue of the arrangement shown and described, individual mounting and exchangeability of the cooling tube 2 and an individual tensioning and replacement of the wire cable 8,9,12 is made possible.

Figure 2:
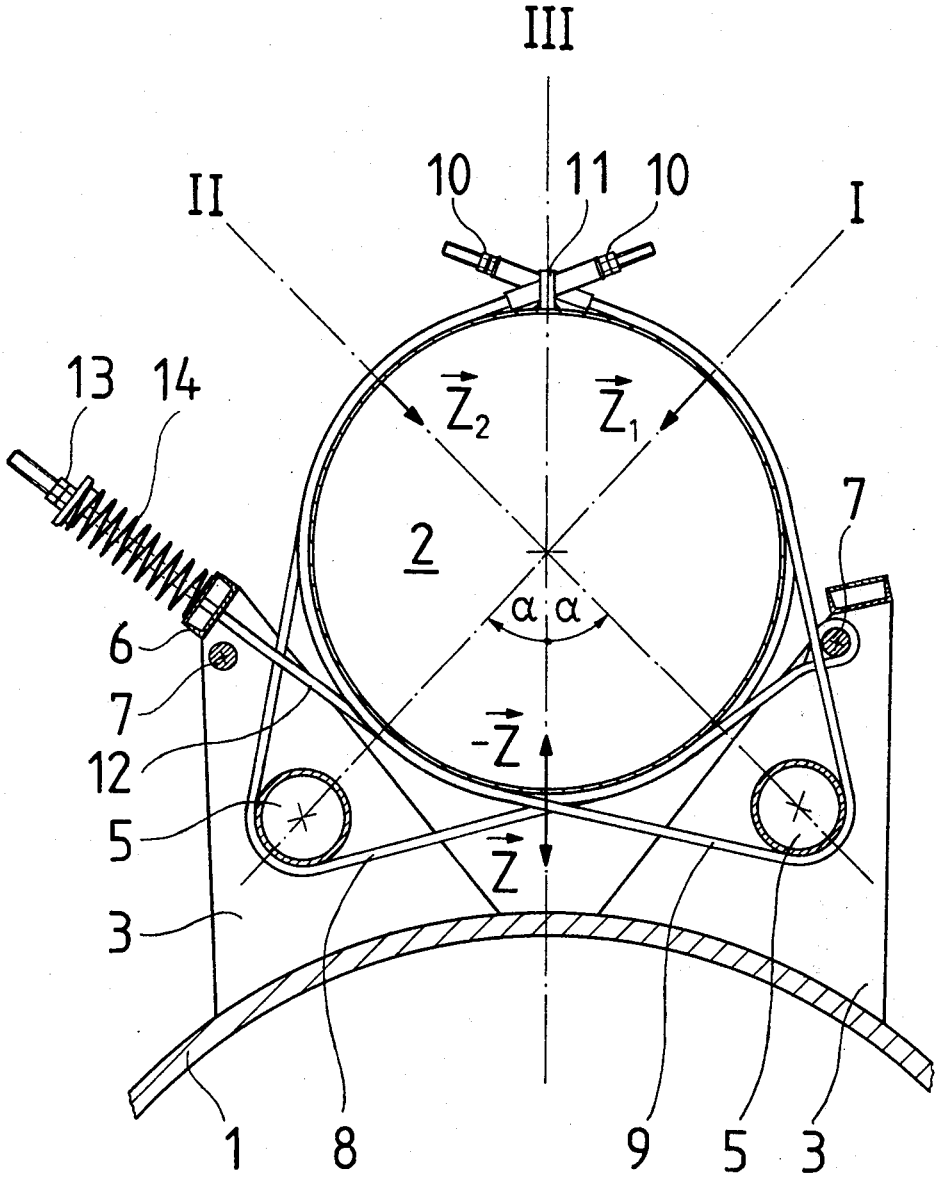
FIG. 2 shows a detail from FIG. 1 on a larger scale, which illustrates a suspension element for a cooling tube.

The three wire cables 8,9 and 12 constitute a suspension element 15 which is shown on a larger scale in FIG. 2 for better understanding.

It is clear from this figure that the plane I, containing the cooling tube axis and the axis of the anchorage pipe 5 of the one traction cable 8 to the left of the cooling tube 2, and the plane II, containing the cooling tube axis and the axis of the anchorage tube 5 of the other traction cable 9 to the right of the cooling tube 2, are inclined symmetrically by the same angle $\alpha$ with reference to the radial plane III (vertical plane in FIG. 2) through the cooling tube axis and the kiln axis (not shown in FIG. 2). The angle $\alpha$ may be 35° to 60°.

Apart from the total weight of the cooling tube 2 and of the material being cooled, the force vector of which revolves relatively to the cooling tube 2 in the opposite direction to the revolution of the kiln during service, a consideration of the forces generated by the three wire cables 8,9,12 of the suspension element 15 solely on the cooling tube 2 leads to the following conclusions.

Due to the described arrangement, the tensile force componenets $\vec{Z}_1$, $\vec{Z}_2$ originating from the two traction cables 8,9 and each directed, as a partial resultant, counter to the associated anchorage pipe 5, produce a resultant tensile force $\vec{Z}$ directed towards the kiln axis in the radial plane III, which is maintained in equilibrium by a tensile force $-\vec{Z}$ generated by the third wire cable 12 and acting in the opposite direction along the same line of action.

The reduction of the forces applied to the cooling tube envelope by the three wire cables 8,9,12 separately in each case to the line of action of their resultants $\vec{Z}_1$, $\vec{Z}_2$, $-\vec{Z}$, results in a so-called three-point loading of the cooling tube 2 by the suspension element 15. However the uniform distribution of forces at the circumference of the cooling tube 2 prevents any abrupt deformations of the cooling tube cross-section threatened by stress peaks.

FIG. 2 further shows that the bracket 11 which is welded to the cooling tube 2 along its outer surface line diametrally opposite the revolving tubular kiln 1, lies substantially in the radial plane III.

Figure 3:
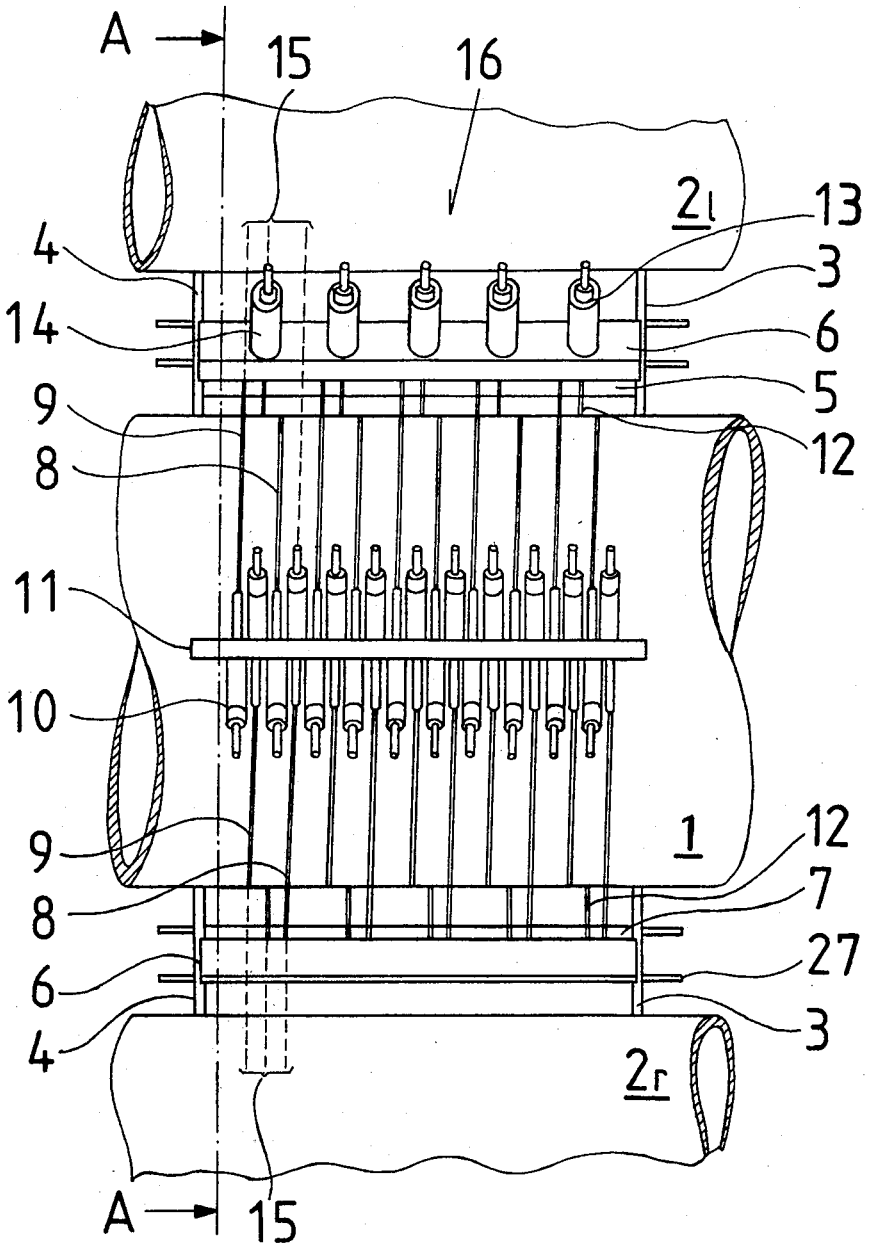
FIG. 3 shows a side elevation of the kiln satellite cooler according to FIG. 1.

FIG. 3 shows the complete suspension means 16 of the same cooling tube 2 as in FIGS. 1 and 2 at one of two support locations 17,18 (see FIG. 4) constituted by e.g. five suspension elements 15 each comprising three wire cables 8,9,12. However the number of the suspension elements 15 may be chosen in accordance with the particular requirements.

The two traction cables 8,9 and the third wire cable 12, disposed between them, of the extreme lefthand suspension element 15 in FIG. 3 are marked by dashed reference lines.

For greater ease of reference the illustration of the identical suspension elements 15 of the adjacent cooling tubes 2 has been omitted.

Figure 4:
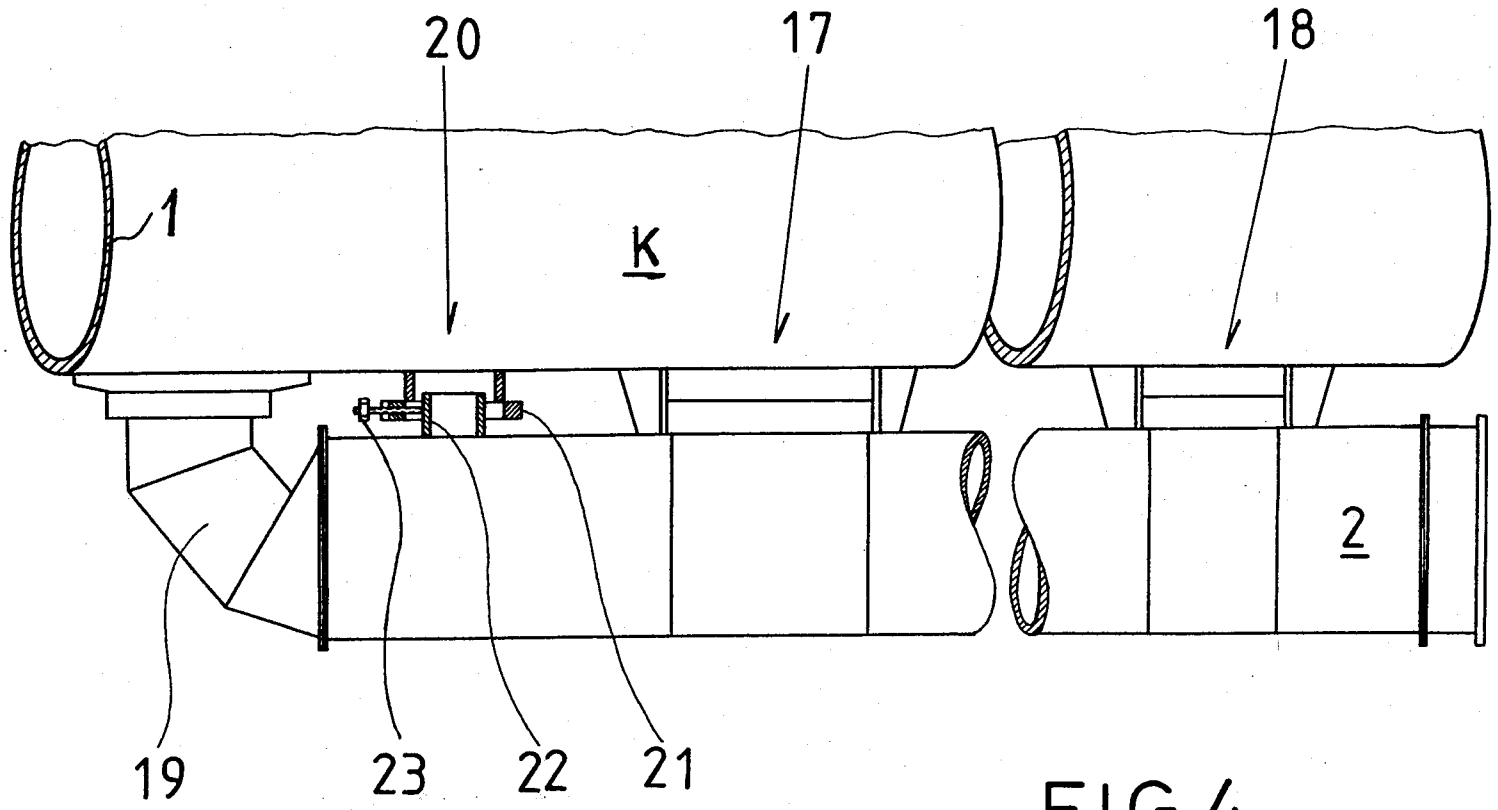
FIG. 4 shows in side elevation the association of a satellite cooling tube with the kiln.

FIG. 4 illustrates the association of the cooling tubes 2 with the rotary tubular kiln. Each cooling tube 2 is maintained on the kiln casing 1 in the discharge region thereof at two support locations 17,18 spaced apart in the axial direction thereof. The cooling tube end on the inlet side communicates through an inlet pipe 19 with the interior of the rotary tubular kiln K and is also fixed in the axial direction by a retaining device 20 fixed to the kiln casing 1.

The retaining device 20 comprises two telescopic pipe sections 21,22 of which the pipe section 21 of greater diameter is attached firmly to the kiln casing 1 and the pipe section 22 of smaller diameter to the cooling tube shell. The larger pipe section 21 has a plurality of radially oriented screws 23 which are driven towards the smaller pipe section 22 leaving slight play to allow for thermal expension.

Figure 5:
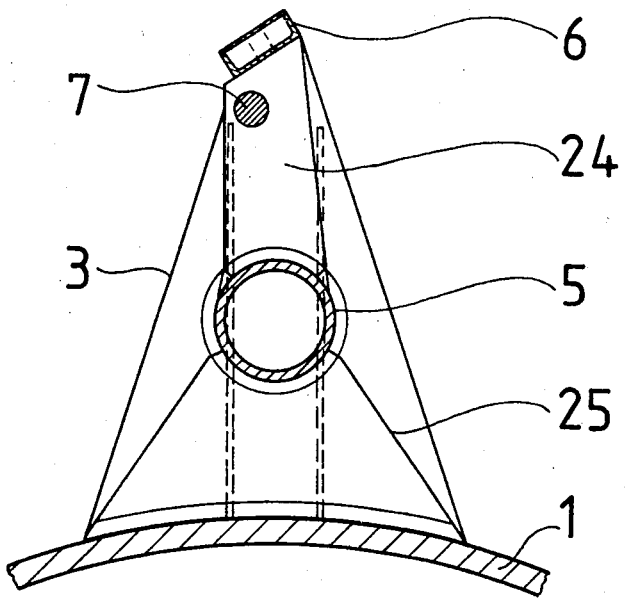
FIG. 5 shows a bracket of a pair of brackets mounted on the kiln casing for the anchorage elements of the wire cables on a larger scale.
Figure 6:
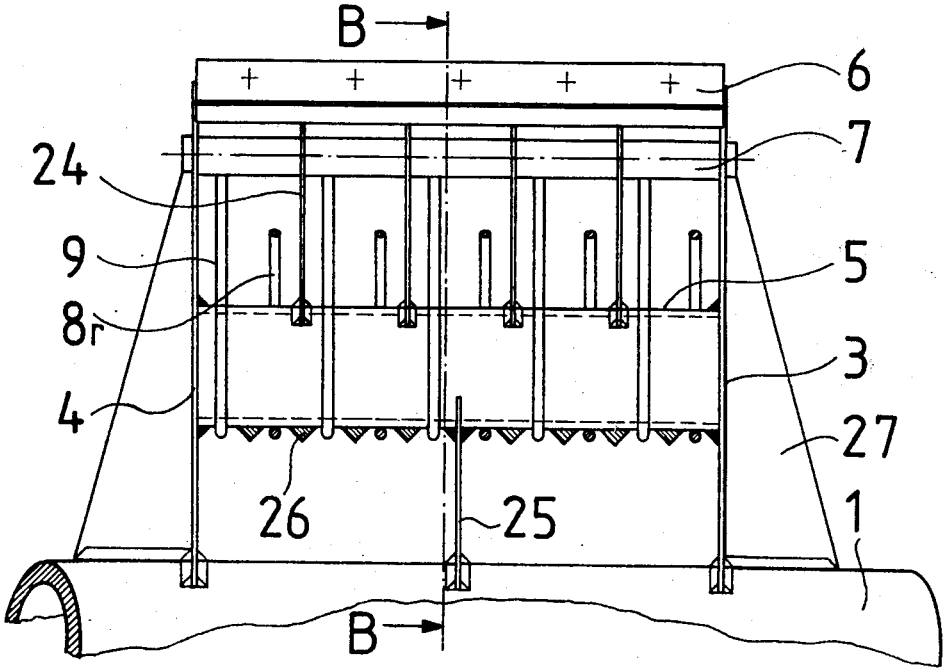
FIG. 6 shows the pair of brackets to which the bracket in FIG. 5 belongs, with the anchorage elements for the wire cables attached thereto.

In both FIGS. 5 and 6, the construction of the support and anchorage elements of the pair of brackets 3,4 to the right of the cooling tube 2 in FIG. 1 is illustrated on a larger scale, viewed e.g., from the direction of the right-hand adjacent cooling tube 2. FIG. 5 shows a radial section through the anchorage elements 5, 6, 7 of the pair of brackets 3, 4 illustrated in FIG. 6, taken on the section plane B—B.

The shape of struts 24 for bracing the rectangular anchorage beam 6 against the anchorage pipe 5, and that of a strut 25 for bracing the anchorage pipe 5 against the kiln casing 1 may be seen in axial elevation from FIG. 5.

As FIG. 6 clearly shows, the rectangular anchorage beam 6, which is subjected to heavy loading more particularly by the radial thermal expansion of the cooling tubes 2, is braced by means of the struts 24 in the intervals between the anchorage points of the third wire cables 12 of all the suspension elements 15 for the relevant cooling tube 2 against the anchorage pipe 5 of the same pair of brackets 3, 4. The rigid anchorage pipe 5 requires only one strut for its bracing and is provided on its outer surface with guide profiles 26 for the lateral location of the traction cables 8, 9 extending therebetween (cp FIG. 1).

The two brackets 3, 4, of the bracket pair have two ribs 27 on their respective outer sides.

The suspension means described above permits, as is easily demonstrated by FIGS. 1 to 4, unobstructed thermal expansion of the cooling tubes 2 of the satellite cooler not only in the axial but also in the radial direction.

The cooling tubes 2 are further able to sag in every possible plane containing their axes under their constantly fluctuating loading by the cooled material during service, without risk of damage to the tubular kiln casing 1, cooling tubes 2 and suspension elements 15.

The enlargement of the cross-sectional area of the cooling tubes 2 due to their radial thermal expansion is absorbed partly by the thermal expansion of the wire cables 8,9,12 and partly by the elasticity thereof and more particularly by the elasticity of the springs 14 at the one end of the third wire cables 12, whilst the latter are displaced towards the kiln casing 1.

In order to reduce their stressing in tension and flexure by the composite loading during service of the kiln, the wire cables 8,9,12 can move slightly in the axial direction on the cooling tube shell.

In the absence of rigid joints between tubular kiln casing 1 and cooling tubes 2, the conditions leading to local stress concentrations in the latter and in the suspension elements 15 are largely eliminated.

What is claimed is:

1. In a combination with a rotary tubular kiln comprising a kiln casing, satellite cooler means comprising: a plurality of cooling tubes, each comprising inlet sides; support means holding said cooling tubes relative to said kiln casing in a discharge region of said kiln at a plurality of locations spaced axially along said kiln; and inlet pipes connecting said cooling tubes with the interior of said kiln at the inlet sides of said cooling tubes, said support means comprising wire cables forming suspension means to allow for thermal expansion of said cooling tubes.

2. The invention as claimed in claim 1, further comprising a plurality of pairs of brackets mounted on said kiln casing at each of said support locations, the number of said pairs of brackets corresponding to the number of said cooling tubes; and anchorage elements between the respective brackets of each said pair of brackets for anchorage thereto of said wire cables.

3. The invention, as claimed in claim 1 comprising individual suspension means for each said cooling tube associated therewith, said individual suspension means comprising said support means and being independent of the individual suspension means for the others of said cooling tubes, each of said suspension means comprising said wire cables.

4. The invention, as claimed in claim 3, wherein each said suspension means comprises a plurality of suspension elements, said suspension elements comprising first and second pretensioned wire cables mounted to exert a resultant force on said cooling tube to urge it towards said kiln casing and a third pretensioned wire cable mounted to bear against said cooling tube to exert force in oposition to the resultant force exerted by said first and second wire cables.

5. The invention as claimed in claim 4 comprising at least one resilient anchoring means for at least one of said first second and third wire cables.

6. The invention as claimed in claim 4, wherein at least one of said first second and third wire cables has an inherent enhanced resiliency and comprises a resilient anchorage means for that cable.

7. The invention, as claimed in claim 4, further comprising a plurality of pairs of brackets mounted on said kiln casing at each of said support locations, the number of said pairs of brackets corresponding to the number of said cooling tubes; and anchorage elements between the respective brackets of each said pair of brackets for anchorage thereto of said wire cables, said anchorage elements including anchorage beams, said third wire cable of each said suspension element of each said cooling tube bearing against a portion of the surface of its respective cooling tube between said first and second wire cables of said suspension element, said third wire cable being tensioned between said anchorage beams of two said pairs of brackets either side of said respective cooling tube so as to bear against said portion of said surface of said respective cooling tube along an arc theretof facing said kiln casing and said third cable including resilient anchorage means to anchor said third cable to at least one of said anchorage beams.

8. The invention, as claimed in claim 4, further comprising a plurality of pairs of brackets mounted on said kiln casing at each of said support locations, the number of said pairs of brackets corresponding to the number of said cooling tubes; anchorage elements between the respective brackets of each said pair of brackets for anchorage thereto of said wire cables, said anchorage elements comprising anchorage beams, each of said anchorage beams having an axis, said first wire cable of each said suspension element of each said cooling tube embracing the respective cooling tube and a first anchorage beam of a pair of brackets on one side of said respective cooling tube, and said second wire cable of said suspension element embracing said respective cooling tube and a second anchorage beam of a pair of brackets on the other side of said respective cooling tube, said first and second wire cables bearing against first and second outer portions of the surface of said respective cooling tube along respective arcs remote from the anchorage beams which they respectively embrace, such that first and second imaginary planes respectively containing the axis of said respective cooling tube and, as to said first plane, the axis of said first anchorage beam and, as to said second plane, the axis of said second anchorage beam, said two planes are inclined symmetrically at an angle not less than 35° and not more than 60° with respect to an imaginary radial plane containing the axis of said respective cooling tube and the axis of said rotary tubular kiln; brackets fixed to said respective cooling tube at a location contained in said radial plane remote from said kiln casing; and tensioning devices associated with said brackets, the ends of said first and second wire cables being anchored to said brackets by way of said tensioning devices.

9. The invention, as claimed in claim 8, wherein said brackets have bores for the passage of said ends of said first and second wire cables therethrough, and said first and second wire cables cross in the region of said brackets to which said wire cables are anchored.

10. The invention, as claimed in claim 1 or 2, further comprising an axial holding device for holding each said cooling tube axially in position relative to said kiln, said axial holding device being disposed intermediate said inlet pipe associated with that cooling tube and the one of said support locations nearest said inlet pipe.

11. In a combination with a rotary tubular kiln comprising a kiln casing, satellite cooler means comprising: a plurality of cooling tubes, each comprising inlet sides; support means holding said cooling tubes relative to said kiln casing in a discharge region of said kiln at a plurality of locations spaced axially along said kiln; and inlet pipes connecting said cooling tubes with the interior of said kiln at the inlet sides of said cooling tubes, said support means comprising wire cables forming suspension means to allow for thermal expansion of said cooling tubes, and at least part of said wire cables being pre-tensioned and mounted to urge said cooling tubes away from said kiln casing.

* * * * *